United States Patent [19]

Disston et al.

[11] Patent Number: 4,520,896

[45] Date of Patent: Jun. 4, 1985

[54] FOLDABLE LADDER

[76] Inventors: Horace C. Disston; Timothy J. Eichfeld, both of 217 S. Hurffville Rd., Deptford, N.J. 08096

[21] Appl. No.: 596,835

[22] Filed: Apr. 4, 1984

Related U.S. Application Data

[63] Continuation-in-part of Ser. No. 264,299, May 18, 1981, , and Ser. No. 515,559, Jul. 29, 1983.

[51] Int. Cl.[3] ..... E06C 1/20; E06C 1/383

[52] U.S. Cl. ..... 182/22; 182/156; 182/168

[58] Field of Search ..... 182/22–24, 182/156, 163–167, 168, 177, 129

[56] References Cited

U.S. PATENT DOCUMENTS

| | | | |
|---|---|---|---|
| 229,552 | 7/1880 | Phelps | 182/24 |
| 353,868 | 12/1886 | Koerner | 182/24 |
| 572,201 | 12/1896 | Hausmann | 182/168 |
| 826,582 | 7/1906 | Laird | 182/124 |
| 1,051,950 | 2/1913 | Francis | 182/180 |
| 1,206,628 | 11/1916 | Webster | 182/180 |
| 1,973,774 | 9/1934 | Pflugradt | 182/163 |
| 2,997,127 | 8/1961 | Wojtowicz | 182/172 |
| 3,311,190 | 3/1967 | Naumann | 182/129 |
| 3,912,043 | 10/1975 | Brannan | 182/23 |
| 4,030,565 | 6/1977 | Chaput | 182/186 |
| 4,483,415 | 11/1984 | Disston | 182/22 |

FOREIGN PATENT DOCUMENTS

| | | | |
|---|---|---|---|
| 430985 | 8/1967 | Switzerland | 182/24 |

*Primary Examiner*—Reinaldo P. Machado
*Attorney, Agent, or Firm*—Robert K. Youtie

[57] ABSTRACT

A ladder including a lower step section and a strut pivotally connected together at their upper ends for swinging movement between a collapsed position toward each other and a downwardly divergent erected position, an upper step section pivoted to the upper end of the lower step section for swinging movement between a folded position along the lower step section and an erected position inclining as an extension of the lower step section, and a catch pivotally connected to the upper step section for swinging movement between a gravitationally depending retracted position along the upper step section when the ladder is folded to a gravitationally depending position from the upper step section to hooked engagement with a lug on the lower step section when the upper step section is extended.

10 Claims, 8 Drawing Figures

FIG. 1
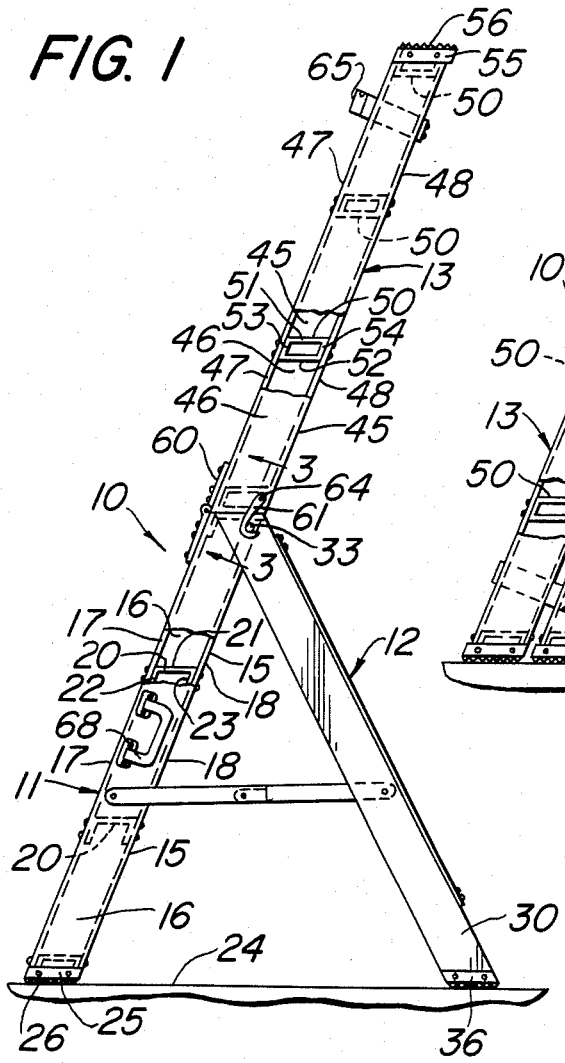
FIG. 2
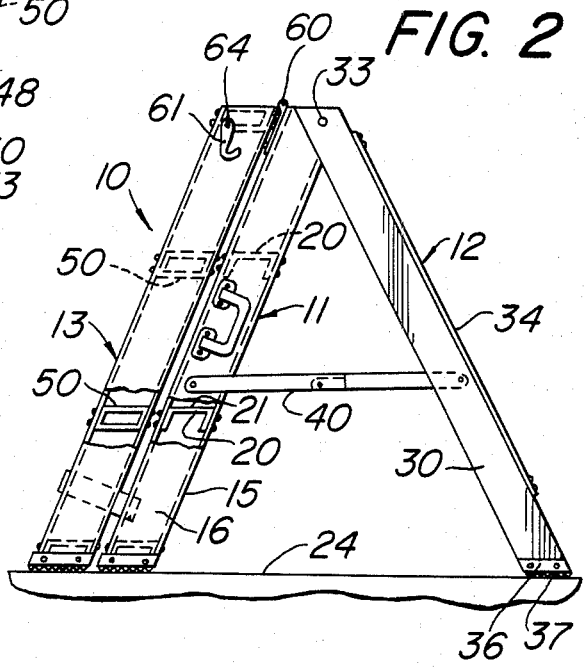
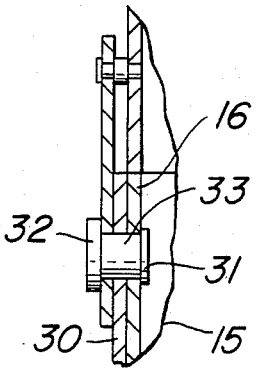
FIG. 3
FIG. 4
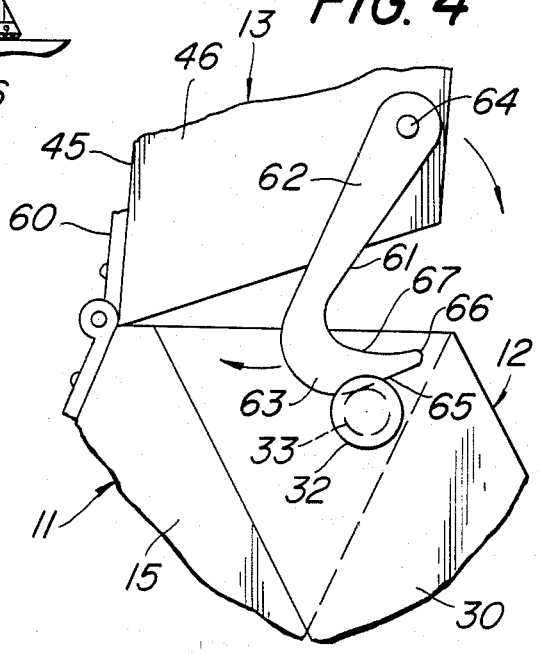

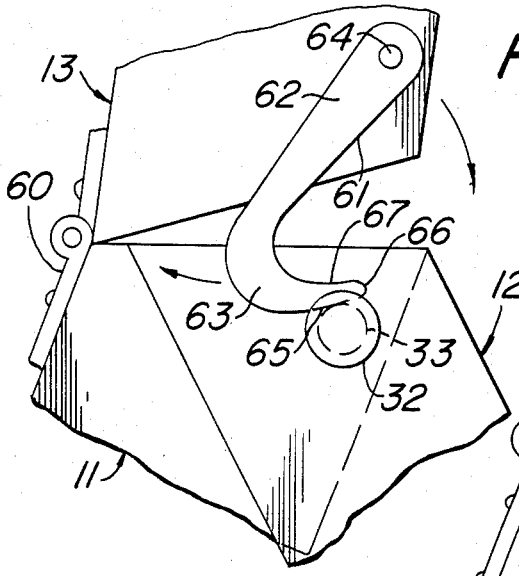
FIG. 5
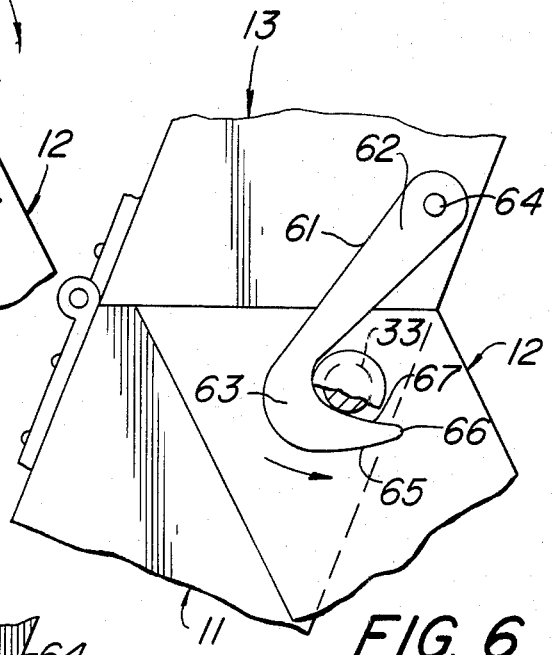
FIG. 6
FIG. 7
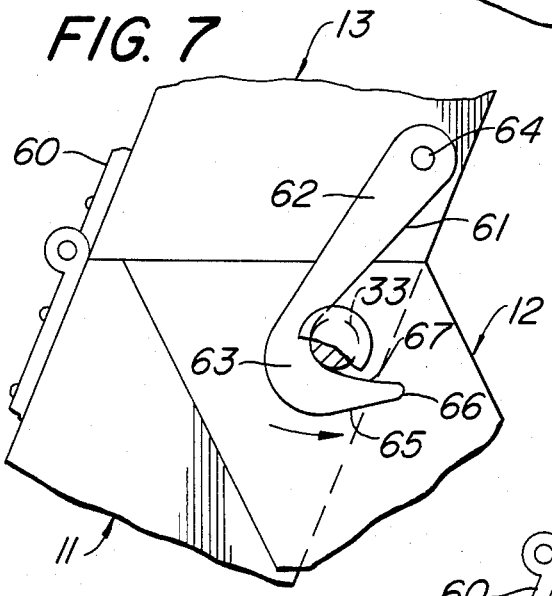
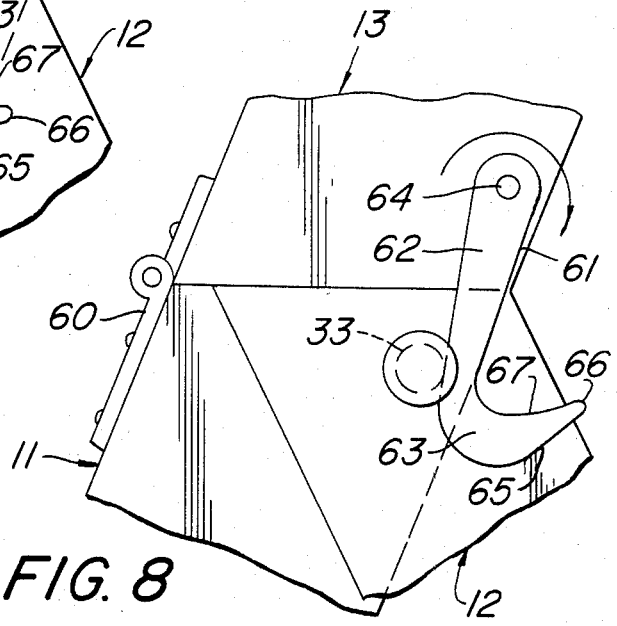
FIG. 8

FOLDABLE LADDER

CROSS-REFERENCES TO RELATED APPLICATIONS

This application is a Continuation-in-Part of my copending U.S. patent applications Ser. No. 264,299 filed May 18, 1981 and Ser. No. 515,559 filed July 29, 1983.

BACKGROUND OF THE INVENTION

Prior art self-standing, collapsible ladders have not been entirely satisfactory, requiring compromises in desired size, height and stability in use for satisfactory bulk, weight and size in handling and storage. Further, prior self-standing, collapsible ladders have been difficult to erect and collapse, without unduly compromising safety.

Applicants are aware of the below listed prior art patents:

| U.S. PAT. NO. | PATENTEE |
|---|---|
| 826,582 | Laird |
| 1,051,950 | Francis |
| 1,206,628 | Webster |
| 1,973,774 | Pflugradt |
| 3,311,190 | Naumann |
| 4,030,565 | Chaput |

| SWISS PATENT NO. | PATENTEE |
|---|---|
| 430,985 | Spoerle |

SUMMARY OF THE INVENTION

It is among the important objects of the present invention to provide a self-standing, collapsible ladder composed essentially of lower and upper step sections pivotally connected together, and a strut section pivotally connected to the lower step section adjacent to the pivotal connection between the step sections, which ladder is relatively staunch and sturdy in its erected condition; capable of closely approaching and directly facing a work area; collapsible to occupy a minimum of space for ease of storage and handling; and wherein a uniquely simple and highly advantageous catch construction is substantially automatic in operation to greatly facilitate erection and collapse of the ladder, and is extremely simple in construction for economy in manufacture and reduction in costs.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a side elevational view showing the ladder of the present invention in an extended position of use.

FIG. 2 is a side elevational view showing the instant ladder in a retracted condition of use.

FIG. 3 is a fragmentary sectional view taken generally along the line 3—3 of FIG. 1.

FIG. 4 is a partial side elevational view illustrating the catch structure of the instant invention in an intermediate position of ladder extension from the condition of FIG. 2 to the condition of FIG. 1.

FIG. 5 is a partial side elevational view similar to FIG. 4 showing a slighter later stage in the ladder extension procedure.

FIG. 6 is a partial side elevational view similar to FIG. 4 and 5, showing still a later stage in the ladder extending procedure.

FIG. 7 is a partial side elevational view similar to FIGS. 4–6, showing a final stage of the catch construction in the ladder extended position.

FIG. 8 is a partial side elevational view similar to FIGS. 4–7, and illustrating an initial stage in return of the ladder from its extended position of FIG. 1 to its retracted condition of FIG. 2.

DESCRIPTION OF THE PREFERRED EMBODIMENT

Referring now more particularly to the drawings, and specifically to FIGS. 1 and 2 thereof, a collapsible, free standing or self-supporting ladder is there generally designated 10, and may include a lower front or step section 11 having its upper end pivotally connected to the upper end of a rear section or strut 12. An upper step section 13 has its lower end, as seen in FIG. 1, pivotally connected to the upper end of the lower section 11 and extending upwardly therefrom in alignment therewith.

Thus, in the extended or fully erected condition of the ladder 10, the upper section 13 extends in general alignment with and from the upper end of the lower section 11 beyond the upper end of the strut 12. In the partially erected, or retracted use condition of FIG. 2, the upper section 13 is swung about its pivotal connection to the lower section 11, extending closely in overlying relation along and in front of the latter.

In the fully collapsed condition, the sections 11 and 13 extend closely longitudinally along in parallelism with each other, while the rear section strut 12 is swung toward the lower section 11 to extend closely along and in parallelism with and at least partially receiving the lower section 11. As the free sections 11, 12 and 13 are generally equal in length and approximately coextensive with each other, this fully collapsed condition occupies a minimum of space.

The lower section 11 may be composed of a pair of longitudinal members or side pieces 15, which may be substantially identical but of opposite hand. The longitudinal members or side pieces 15 are advantageously fabricated of channel stock, each including a web 16 extending between a pair of forward and rearward inturned flanges 17 and 18. The front flanges 17 of both side pieces or channels 15 are generally coplanar, as are the rear flanges 18.

A plurality of lateral members or steps 20 extend generally horizontally in parallelism with each other at equally spaced elevations between the side members 15. Each step 20 is of a downwardly facing channel-like configuration, having its opposite end portions extending into the hollow of respective side members 15, the steps 20 each terminating with its opposite ends proximate to a respective side member web 16; and having a generally horizontal top web or tread wall 21, and having forward and rearward depending flanges 22 and 23, respectively in facing engagement with and suitably secured to the front and rear side member flanges 17 and 18.

As best seen in FIGS. 1 and 2, the lower ladder section 11 inclines rearwardly as from a supporting surface or floor 24, with the lower ends of the side members 15 generally horizontal, so as to be at an angle with respect to the longitudinal direction of the side members. Further, the steps of lateral members 20 are generally horizontal, both laterally and forwardly and rearwardly, while their depending flanges 22 and 23 decline forwardly for the above-mentioned facing engagement with flanges 17 and 18.

On the lower ends of side members 15 may be secured suitable lower end closures or caps 25, which may be provided on their undersides with frictional ground engaging material or footpads 26.

As illustrated, the lower section 11 may include four steps 20, with the lowermost and uppermost steps contiguous to the lower and upper ends of the side members 15; or other number and arrangement of steps, if desired.

The rear section or strut 12 may be composed of a pair of laterally spaced, generally parallel, elongate side members 30, each of which may be fabricated of angle stock, if desired. The side members 31 of the strut 12 may have their upper end portions outwardly of and overlying the upper end portions of respective lower section side walls 15, and pivotally secured thereto, as by pivot pins 33. A single elongate pivot pin 33 may extend laterally between and through both strut side members 30; or, a pair of aligned pins 33 may be employed, one at each side as illustrated, see FIG. 3. The pivot pins 33 may each include on its inner end a retaining enlargement or head 31 on the inner side of the respective wall 16 of side member 15, and may extend through and beyond the adjacent strut member 30, being provided spacedly outwardly therefrom with an enlargment or head 32, for a purpose appearing presently.

The strut side members 30 are relatively immovably tied together, as by suitable bracing 34, as desired.

In the erected or use condition of FIGS. 1 and 2, the strut 12 declines rearwardly from the upper end of the lower step section 11, being approximately equal in length to the latter and has its opposite ends generally horizontal. On the lower ends of the strut members 30, may be provided end members or caps 36 which may have on their undersides frictional ground engageable pads or feet 37. Thus, the pivotally connected lower section 11 and strut 12 diverge downwardly in the erected or set-up condition, and may be pivoted toward each other about their upper ends into collapsed or nonuse condition. Outward swinging movement of the lower section 11 from the strut 12 to the erected condition is limited by one or more pivoted linkages 40 connected between the lower section and strut. As the strut members 30 are each spaced outwardly of its adjacent lower step section side piece 15, the linkages 40 may be connected at their opposite ends to the external surface of each lower section wall 16 and the internal surface of each strut member 30, folding or collapsing upon collapse of the lower step section 11 and strut 12 into the space between the adjacent side member 15 and strut member 30.

The upper step section 13 includes a pair of generally parallel ladder sides or longitudinal members 45, which may each be a channel, similar to the channels 15 of the lower section 11. Each upper section side member channel 45 may include a wall or web 46, and a pair of front and rear flanges 47 and 48, as seen in FIG. 1. The channel side members 45 extend in parallelism with each other, and in respective alignment with channel side members 15 of the lower step section, when in the extended position of use. Thus, each channel web or wall 46 will be in longitudinal alignment with a respective channel web or wall 16, and similarly channel flanges 47 and 48 will be in respective alignment with channel flanges 17 and 18.

A plurality of lateral members or steps 50 extend horizontally in parallelism with each other, and at equally spaced elevations between the upper section side members 45. The upper section steps 50 have their opposite ends extending between the side member flanges 47 and 48, and terminate proximate to the side member webs 46. As best seen in FIGS. 1 and 2, the upper section steps 50 may each be elongate and of a constant, box-like, trapezoidal cross-sectional configuration. As seen in FIGS. 1 and 2, the step members 50 each include upper and lower tread walls 51 and 52, and front and rear edge walls 53 and 54. Further, the edge walls 53 and 54 are advantageously in flush facing engagement with respective front and rear flanges 47 and 48; and, as the latter incline rearwardly in alignment with the lower section, so do the edge walls 53 and 54 incline rearwardly. Any suitable securing means may be employed to secure the steps 50 fast to the side members 45; and, the steps are located in vertically spaced relation with each other, and with respect to the lower section steps 20, to form a substantially continuous ladder having approximately equal rise or distances between steps. The lowermost and uppermost steps 50 of the upper section 13 are located at the lower and upper ends of the upper section, as when the ladder is extended in the position of FIG. 1.

Connecting the upper and lower sections 13 and 11 for swinging movement between the extended position of FIG. 1 and the retracted position of FIG. 2 are suitable hinge means, such as strap hinges 60. The strap hinges may each include hinge parts respectively secured to adjacent portions of flanges 17 and 47, whereby the upper section 13 is swingable from its extended position to its retracted position. In the retracted position of FIG. 2, it will be apparent that the upper section 13 is of a length substantially equal to that of the lower section 11; and that the upper and lower sections are substantially equal in length to that of the strut 12. Also, it will be apparent in FIG. 2 that the steps 50 of the upper section in its retracted position are substantially coplanar with the steps 20 of the lower section. The previously lower or underwall 52 of each step 50 is now uppermost (see FIG. 2) and substantially coplanar with the respective wall 21 of the adjacent lower section step 20. By this construction the upper and lower steps 20 and 50 combine in the retracted position of FIG. 3 to provide steps of greatly increased depth, for increased comfort and safety.

The distal ends of the side members 45 of the upper step section 13 (uppermost in FIG. 1) may be provided with end members or caps 55 and frictional pads or feet 56. As the ends of upper section side members 45 extend oblique to the longitudinal dimension of the side members, in the same manner as the construction of the lower section 11, the opposite ends of both upper and lower sections 13 and 11 are substantially coplanar with each other in the retracted position of FIG. 2. Further, the adjacent steps 20 and 50 at the hingedly connected end of the upper and lower sections provide a coplanar step of substantial depth, while the ends of the upper and lower sections remote from the pivotal connection are generally coplanar and both in frictional ground engagement, as by the pads or feet 26 and 56.

In the fully extended position of FIG. 1, the lower and upper sections 11 and 13 are in end-to-end abutting engagement for effectively supporting a load on each section. Carried externally by the upper step section 13, exteriorly of each wall 46, is a catch or hook 61. More specifically, a catch or hook 61 may be provided externally on each upper step section side member 45, adjacent to the pivoted end thereof. The single hook or catch 61 may suffice, if desired, and only a single such hook or catch will be described in detail. The hook or catch 61 includes an elongate portion or shank 62 having at one end a curved end extension or bight 63. The other end of the shank 62 is pivotally connected to the exterior of upper section side piece wall 46, adjacent to the pivotally connected end of the side piece, as by a pivot or pin 64 carried by the side piece 45.

The pivot pin 64 is at a location generally horizontally forwardly of the pin or lug 33 in the retracted use condition of FIG. 2; and the pivot pin 64 swings upwardly and rearwardly upon extension of the upper step section 13 to a position generally over the lug 33, as in FIG. 1. During movement of upper step section 13 from its retracted position of FIG. 2 to its extended position of FIG. 1 the upper step section moves through a position shown in FIG. 4. It will there be observed that the pivot 64 is generally over the lug 33 and the hook or catch 61 depends freely by gravity into engagement with the lug 33. More specifically, the external edge 65 of the bight portion 63 engages the lug 33, and specifically engages the shank portion thereof inward of the head 32. The catch surface or edge 65 is of a radius of curvature about the pivot 64 decreasing in the direction toward the free end 66 of the bight. Thus, the edge surface 65 slants upwardly and rearwardly toward the free end 66, so as to ride downwardly and forwardly through the position shown in FIG. 5 until the free end rides over the lug 33. Thereupon gravity urges the catch 61 downwardly and rearwardly with the inner surface or edge 67 of the bight portion 63 engaging the underside of the lug 33. The radius of curvature of the inner bight edge 67 about the axis of pin 64 is decreasing in the direction away from the free bight end 66, so that the catch or hook 61 will gradually swing counterclockwise as the upper step section 13 is swung to its limiting position in end-to-end abutting engagement with the lower step section 11, shown in FIG. 6.

In this free, gravity fall condition of hook or catch 61 of FIG. 6, the catch is frictionally retained with lug 33 engaging inner hook edge 67 spaced from the hook shank 61. Additional manual force may be applied to the catch 61 in the counterclockwise direction to swing the hook or catch to a limiting position with the lug 33 engaging the shank 62. In this condition the upper and lower step sections 13 and 11 are secured in their extended, aligned relation without looseness or play, for maximum sturdiness and safety.

When it is desired to return the ladder 10 to its retracted use condition of FIG. 2, or a fully collapsed condition, the hook or catch 61 may be swung clockwise from the position of FIG. 7 to the position shown in FIG. 8, where the lug 33 has been totally removed from the bight portion 63, and the hook shank 62 may engage the lug 63 on its outer side remote from the bight portion. This is a fully stable condition of the hook or catch 61, so that if a hook or catch is provided on each side of the ladder, they may individually and independently be swung out of their retaining conditions of FIG. 7 into their nonretaining conditions of FIG. 8. The upper step section 13 is then free to swing relative to the lower step section 11 about the axis of hinge 60.

A resilient spring strip or clasp 65 may extend forwardly from one of the step sections 11 or 13, such as from the upper region of upper step section 13. The spring strip or clasp 65 will move with the upper section 13 for snap interengagement with the lower section 11 when the step sections are retracted to the position of FIG. 2, so as to releasably retain the step sections in their retracted relation. In the extended condition, the spring strip or clasp 65 projecting forwardly from the upper step section 13 may provide a paint can holder, as by engagement beneath the bail of a paint can.

In addition, portability is facilitated by the provision of a hand grip or handle 68 on one side member, say a side member 15 spaced medially between side member ends.

It will now be apparent that the operative condition of FIG. 1 illustrates the ladder of the present invention as providing close and directly facing access to a work surface or wall, in contrast to conventional folding ladders. It has further been found that the instant ladder is of ample vertical extent for many purposes while being readily portable by its light weight and fabrication of aluminum extrusions, and minimum collapsed size, permitting of portage by car, through conventional doorways, including revolving doors, and even storable beneath a standard workbench. As the supporting structure of lower section 11 and strut 12 are of less length than a conventional folding ladder, there is less flexibility for increased sturdiness and improved safety.

From the foregoing, it is seen that the present invention provides a free standing, collapsible ladder, which is sturdy and durable through a long useful life, affording great versatility in use, easily portable and stored, and provides unique automatic features in setting up and taking down.

Although the present invention has been described in some detail by way of illustration and example for purposes of clarity of understanding, it is understood that certain changes and modifications may be made within the spirit of the invention.

What is claimed is:

1. A foldable ladder comprising a lower step section for use inclined in one direction on a horizontal supporting surface, a strut having one end pivotally connected to one end of said lower step section for use inclined in the opposite direction on a horizontal supporting surface, limit means connecting said lower section and strut for limited swinging movement away from each other, an upper step section having one end pivotally connected to said one end of said lower step section for swinging movement between a retracted position lying along said lower step section and an extended position in alignment with said lower step section, a lug on one of said lower step section and strut, and a catch pivotally connected to said upper step section for swinging movement between a retracted position depending along said upper step section when the latter is retracted to a position depending from said upper step section into hooked engagement with said lug when said upper step section is extended, for retaining said upper step section securely extended.

2. A foldable ladder according to claim 1, in combination with a pin pivotally connecting said strut and lower step section, and an end extension on said pin defining said lug.

3. A foldable ladder according to claim 2, said catch comprising a hook outboard of said upper step section for interengagement with said lug.

4. A foldable ladder according to claim 1, said catch comprising a hook having an internal radius of curvature decreasing in the direction away from the free hook end, for snug engagement with said lug.

5. A foldable ladder according to claim 1, said catch comprising a hook having an external configuration inclined upwardly toward the free hook end for riding of the free hook end over said lug upon movement of the upper step section to extended position.

6. A foldable ladder according to claim 5, said catch comprising a hook having an internal radius of curvature decreasing in the direction away from the free hook end, for snug interengagement with said lug.

7. A foldable ladder according to claim 6, in combination with a pin pivotally connecting said strut and lower step section, and an end extension on said pin defining said lug.

8. A foldable ladder according to claim 4, said hook being freely pivoted to said upper step section at a location over said lug when said upper step section is being extended so that gravity disposes said external edge configuration into engagement with said lug for said riding over against gravity and subsequently gravity urges said snug engagement of said internal radius of curvature.

9. A foldable ladder according to claim 1, in combination with an additional lug on one of said lower step section and strut and extending opposite to said first mentioned lug, and an additional catch pivotally connected to said upper step section for swinging movement between a retracted position depending along said upper step section when the latter is retracted to a position depending from said upper step section into hooked engagement with said additional lug when said upper step section is extended, said catches each comprising a hook having an open side and a closed side and being swingable to a nonretaining position with the closed side of the hook gravitationally swung toward the associated lug, for independent disengagement of said catches from said lugs.

10. A foldable ladder according to claim 1, said strut having its internal lateral dimension greater than the external lateral dimension of said lower section for relative swinging movement of said lower section toward and into said strut in the non-use condition.

* * * * *